US006071665A

United States Patent [19]

Dickerson et al.

[11] Patent Number: 6,071,665

[45] Date of Patent: Jun. 6, 2000

[54] TONER PROCESSES WITH SURFACE ADDITIVES

[75] Inventors: Charles G. Dickerson, Farmington; Jeffrey L. DeBarr, Williamson; Judith M. Vandewinckel, Livonia, all of N.Y.

[73] Assignee: Xerox Corporation, Stamford, Conn.

[21] Appl. No.: 08/451,379

[22] Filed: May 26, 1995

[51] Int. Cl.[7] ..... G03G 9/08

[52] U.S. Cl. ..... 430/137

[58] Field of Search ..... 430/137, 110

[56] References Cited

U.S. PATENT DOCUMENTS

| | | | |
|---|---|---|---|
| 3,590,000 | 6/1971 | Palermiti et al. | 252/62.1 |
| 4,560,635 | 12/1985 | Hoffend et al. | 430/106.6 |
| 4,678,734 | 7/1987 | Laing et al. | 430/137 |
| 4,965,158 | 10/1990 | Gruber et al. | 430/137 |
| 5,204,208 | 4/1993 | Paine et al. | 430/137 |
| 5,364,730 | 11/1994 | Kojima et al. | 430/137 |
| 5,370,962 | 12/1994 | Anderson et al. | 430/137 |
| 5,510,220 | 4/1996 | Nash et al. | 430/110 |

OTHER PUBLICATIONS

Diamond, Arthur S. (editor) Handbook of Imaging Materials. New York: Marcel–Dekker, Inc. p. 169, 1991.

*Primary Examiner*—Christopher D. Rodee
*Attorney, Agent, or Firm*—E. O. Palazzo

[57] ABSTRACT

A process for the preparation of colored toners which comprises mixing a first toner comprised of resin, pigment particles, charge additive, and surface additives, with a second toner comprised of resin, pigment particles, and charge additive, and wherein the resulting colored toners contain from about 0.05 to about 0.5 weight percent of surface additives.

29 Claims, No Drawings

TONER PROCESSES WITH SURFACE ADDITIVES

BACKGROUND OF THE INVENTION

The present invention is generally directed to toner and developer compositions, and more specifically, the present invention is directed to blending, or mixing processes for the preparation of toner compositions. In embodiments, there are provided in accordance with the present invention processes to achieve effective toner blending or comixing compatibility, that is for example the overlapping of charge spectra and rapid blend admixing of the constituents in a blend of dry toner compositions comprised of resin particles, pigment particles, and optional charge additives dispersed therein, such as quaternary ammonium hydrogen bisulfates, including distearyl methyl hydrogen ammonium bisulfate, and the like by, for example, mixing a toner with a high concentration of additives, or a masterbatch with a toner with no additives; or mixing a first toner with a second toner and wherein the first toner contains additives. Accordingly, in embodiments of the present invention a first color toner with surface additives present in an amount of from about 0.4 to about 0.8 is diluted with a second color toner with no surface additives, and wherein the toner resulting contains surface additives in an amount that is less than that present in the first toner, for example the resulting toner contains two surface additives, each present, for example, in an amount of from about 0.2 to about 0.4 weight percent. More specifically, in embodiments the present invention is directed to the blending of two Xerox Corporation 4850 dry toners with additives in a two step process wherein excessive additives are blended with one toner and the resulting masterbatch is diluted with a second toner that contains no additives. Additives in embodiments refers to surface additives, such as silicas like the AEROSILS®, metal salts of fatty acids, such as zinc stearates, metals, metal oxides, mixtures thereof, and the like. Thus, in embodiments with the present invention there can be obtained a palette, that is for example preselected colored toners, or an extended set of colors by admixing certain toner compositions. One object of mixing or blending is to enable a minimum starting set of toners, such as red, green, blue, cyan, magenta and yellow, to generate many other colors by the method of comixing these toners, pairwise in embodiments, to provide toners with preselected colors, thus each new comixture, with a relative ratio of the constituent pair, can become a new toner to be added to a carrier to form a developer particularly useful in trilevel or color xerography. The aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics, and maintain their triboelectric charging characteristics for an extended number of imaging cycles, exceeding for example 50,000 in a number of embodiments. The toner and developer compositions of the present invention can be selected for electrophotographic, especially xerographic, imaging and printing processes, including trilevel and full color processes.

Toner and developer compositions are generally known, reference for example U.S. Pat. No. 4,338,390, the disclosure of which is totally incorporated herein by reference, wherein there are disclosed developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing toner compositions and processes thereof include U.S. Pat. Nos. 3,944,493; 4,007,293; 4,079,014; 4,394,430; 4,937,157 and 4,560,635, which illustrates a toner with a distearyl dimethyl ammonium methyl sulfate charge additive.

Moreover, toner compositions with negative charge enhancing additives are known, reference for example U.S. Pat. Nos. 4,845,003; 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a process for developing electrostatic images with a toner, which contains a metal complex represented by the formula in column 2, for example, and wherein ME can be chromium, cobalt or iron. Additionally, other patents disclosing various metal containing azo components wherein the metal can be chromium or cobalt include 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

The disclosures of each of the U.S. patents mentioned herein, especially as they relate to toners, are totally incorporated herein by reference.

In U.S. Pat. No. 5,370,962, the disclosure of which is totally incorporated herein by reference, there is illustrated a process for the preparation of colored toners which comprises providing a first toner comprised of resin, pigment particles, internal charge additive, and optional surface additives; adding thereto a second toner comprised of resin, pigment particles, internal charge additive, and optional surface additives; and wherein said toners contain blend compatibility components.

SUMMARY OF THE INVENTION

Examples of objects of the present invention include:

It is an object of the present invention to provide toner and developer compositions.

In another object of the present invention there are provided processes for the preparation of blended or comixed toners with excellent color resolution, and where the resulting toner contains surface additives and dispersed therein known toner additives, such as charge enhancing additives.

In yet another object of the present invention there are provided effective processes for obtaining colored toners with high quality color and excellent consistent color shade by blending a first and second toner, and wherein wrong sign or low charge toner is minimized or eliminated.

Moreover, in another object of the present invention there are provided effective processes for obtaining colored toners other than black and wherein such toners enable xerographic images with minimal, or no background, and wherein with such toners image smearing is avoided, or minimized.

Further, in another object of the present invention there are provided positively or negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference.

Additionally, in another object of the present invention there are provided toner compositions which have the desired triboelectric charge level, for example from about 10 to about 20 microcoulombs per gram, and preferably from about 10 to about 15 microcoulombs per gram, and admix charging rates of from about 5 to about 60 seconds, and preferably from about 15 to about 30 seconds, as determined by the charge spectrograph, preferably, for example, at low concentrations, that is for example less than or equal to about 5 percent, and preferably from about 1 to about 3 percent.

Also, in another object of the present invention there are provided developer compositions with positively or negatively charged toner particles, and carrier particles.

Additionally, in a further object of the present invention there are provided negatively charged colored toner compositions containing therein charge enhancing additives, such as distearyl dimethyl ammonium methyl sulfate (DDAMS), quaternary ammonium hydrogen bisulfate, especially trialkyl ammonium hydrogen bisulfate, or tetraalkylammonium sulfonates, such as dimethyl distearyl ammonium sulfonates, and the like, and on the surface thereof additives of silica, metal salts, or mixtures thereof.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 70 copies per minute.

Further, in another object of the present invention there are provided processes for toner blend compatibility or overlapping in the blend charge spectra, that is for example toners with similar or the same Q/O, and wherein the toner blend possesses excellent admix.

Moreover, in another object of the present invention there are provided processes for obtaining preselected colored toners with rapid blend admixing characteristics by the blending of a number of toners, especially the blending of two toners, and thereafter formulating developer compositions by the addition of carrier particles thereto.

Another object of the present invention resides in the provision of surface treated toners enabling substantially similar or identical charging characteristics thereof, especially of individual toners, and excellent blend compatibility.

These and other objects of the present invention can be accomplished in embodiments thereof by providing toner compositions comprised of resin particles, pigment particles, optional internal charge enhancing additives dispersed therein and additive components on the surface thereof. In embodiments, the present invention is directed to a process for the compatible blending or comixing of toners, especially two toners. More specifically, the process of the present invention comprises mixing a toner with surface additives with a second toner with no surface additives. Accordingly, the process of the present invention in embodiments comprises providing a classified toner with a mixture of surface additives thereon, such as silica and zinc stearate, and mixing thereof with a second toner free of a mixture of surface additives thereon, such as silica and zinc stearate, thereby enabling, for example, the first toner to become concentrated with surface additives prior to dilution with the second toner; or providing a toner free of a mixture of surface additives thereon, such as silica and zinc stearate, and mixing with a classified toner with a mixture of surface additives thereon, such as silica and zinc stearate, Embodiments of the present invention comprise providing or preparing a first toner of resin, pigment like green, and a surface additive mixture of silica and zinc stearate, each present in an amount of 0.5 to about 1, and preferably 0.6 weight percent; and thereafter mixing with a second toner comprised of resin, and a pigment dissimilar than the first toner pigment, like a red pigment. Various effective amounts of the first and second toner can be mixed, such as from about 10 to 95 and preferably about 50 weight percent of the first toner, and from about 10 to 95, and preferably about 50 weight percent of the second toner.

Embodiments of the present invention include a process for the preparation of colored toners which comprises mixing a first toner comprised of resin, pigment particles, charge additive, and surface additives with a second toner comprised of resin, pigment particles, and charge additive, and wherein the resulting toner contains from about 0.05 to about 0.5 weight percent of surface additives; a process for the preparation of colored toners which comprises mixing a first toner comprised of resin, pigment particles, charge additive, and surface additives with a second toner comprised of resin, pigment particles, and charge additive, wherein the surface additives are comprised of silica, metal salts of fatty acids, metal oxides, or mixtures thereof, and preferably fumed silica and zinc stearate, and wherein the amount of silica and the metal salt present in the first toner is from about 0.4 to about 0.7 weight percent, and preferably 0.6 weight, and the amount of the silica and the stearate present in the resulting toner is preferably about 0.3 weight percent; and a process for the preparation of colored toners which comprises adding a first toner comprised of resin, first pigment, charge additive, and surface additives of silica and zinc stearate, for example, and wherein each surface additive is present in an amount of from about 0.4 to about 0.8 weight percent, and preferably 0.6 weight percent, to a second toner comprised of resin, second pigment particles, and charge additive, and wherein the resulting toner contains from about 0.2 to about 0.4, and preferably 0.3 weight percent of surface additives of silica and zinc stearate.

In embodiments, the present invention is directed to a process for the preparation of colored toners, which comprises providing a first masterbatch toner comprised of resin particles, pigment particles and internal charge additive and surface additives, and adding thereto a second toner comprised of resin particles, pigment particles, and internal charge additives, or mixing more than two toners, to obtain a blend of toners which comprises a palette of colors; a process for the preparation of a red color toner mixture, which comprises mixing a first toner composition comprised of a styrene butadiene resin, a magenta pigment, a charge enhancing additive mixture comprised of cetyl pyridinium chloride and an aluminum complex, and surface additives of colloidal silica particles and zinc stearate particles, and a second toner comprised of a styrene butadiene resin, a LITHOL SCARLET™ pigment, a magenta pigment, and a charge enhancing additive comprised of distearyl dimethyl ammonium methyl sulfate; a process for the preparation of a purple color toner mixture which comprises mixing a first toner composition comprised of a styrene butadiene resin, PV FAST BLUE™ pigment, a charge enhancing additive, such as a mixture comprised of cetyl pyridinium chloride and an aluminum complex line BONTRON E-88™ and surface additives of colloidal silica particles and zinc stearate particles, and a second toner comprised of a styrene butadiene resin, a LITHOL SCARLET™ pigment, a magenta pigment, and a charge enhancing additive, such as distearyl dimethyl ammonium methyl sulfate; and a process for the preparation of a blue color toner mixture which comprises mixing a first toner composition comprised of a styrene butadiene resin, NEOPEN BLUE™ pigment, the charge enhancing additive distearyl dimethyl ammonium methyl sulfate (DDAMS), and surface additives of colloidal silica particles and zinc stearate particles, and a second toner comprised of a styrene butadiene resin, a LITHOL SCARLET™ pigment, and a charge enhancing additive comprised of distearyl dimethyl ammonium methyl sulfate. In the aforementioned embodiments, it is preferred that one charge additive be selected, that two surface additives of fumed silica and zinc stearate be selected, and that the amount of each surface additive in the first toner is about 0.6 weight percent, and the amount of each surface additive in the toner product is about 0.3 weight percent.

The processes of the present invention comprise the following steps in embodiments: initially, the toners can be prepared by conventional methods, such as melt mixing resin, pigment, and charge enhancing additive in effective known amounts, for example for the internal charge additive about 0.5 to about 10 weight percent. The surface additives, such as conductivity aids like metal salts of fatty acids, such as zinc stearate and flow aids like AEROSIL®, may be applied either separately or together on one of the toners. Mixing times for the mechanical mixing processes range from about 5 to about 30 minutes, and more typically from about 5 to about 15 minutes, however, other effective times can be selected. More specifically, there is prepared in an extruder, such as Werner Pfleiderer ZSK-53, a first toner with resin, pigment, followed by grinding the pellets obtained, and then subsequently adding two surface additives of fumed silica, and zinc stearate, each present in an amount of from about 0.4 to about 06 weight percent; adding the first toner to a second toner of resin and pigment, and no surface additives, and blending in a Henschel Blender; classifying or screening with a 37 to 105 micron opening Sweco Turbo screen to remove toner agglomerates and other large debris.

A number of known charge additives can be selected for the processes of the present invention including those as illustrated in the patents mentioned herein, the disclosures of each being totally incorporated herein by reference. Specific additives, which additives are preferably dispersed in the toner, include quaternary ammonium compounds, distearyl dimethyl ammonium methyl sulfate, complexes such as BONTRON E-84™ and E-88™ available from Orient Chemical Company, reference U.S. Pat. No. 4,845,003, the disclosure of which is totally incorporated herein by reference, organic sulfonates such as stearylphenethyldimethyl ammonium tosylate (SPDAT), trialkyl hydrogen ammonium bisulfate such as distearyl methyl hydrogen ammonium bisulfate, trimethyl hydrogen ammonium bisulfate, triethyl hydrogen ammonium bisulfate, tributyl hydrogen ammonium bisulfate, dioctyl methyl hydrogen ammonium bisulfate, didodecyl methyl hydrogen ammonium bisulfate, dihexadecyl methyl hydrogen ammonium bisulfate, tris(3,5-di-t-butylsalicylato) aluminum available from Orient Chemical, potassium bis(3,5-di-t-butylsalicylato) borate available from Japan Carlit as LR120™, TN1001 believed to be a calcium salt of salicylatic acid and available from Hodogaya Chemical, tertiary-butyl salicylic acid complexes, aluminum salt and zinc salt complexes, and the like. These additives are present in various effective amounts, such as for example from about 0.01 to about 10 weight percent, preferably from about 0.01 to about 5 weight percent, and more preferably from about 0.01 to about 1.

In embodiments, a first toner, about 50 weight percent, comprised of 92.5 percent resin particles, such as styrene methacrylates or styrene butadienes, 5 percent of pigment, such as magenta like HOSTAPERM PINK™, internal charge additive, such as a mixture of 2 percent of BONTRON E-88™, an aluminum salt complex and 0.5 percent of cetylpyridinium chloride, external surface additives, such as 0.6 percent of AEROSIL®, and 0.6 percent of zinc stearate, is mixed with a second toner, about 50 weight percent, comprised of 92 percent of resin particles, such as styrene methacrylates, or styrene butadienes, pigment, such as LITHOL SCARLET® and 0.28 percent of HOSTAPERM PINK™, and internal charge additive, such as 1 percent of DDAMS, to provide a red toner. Also, in embodiments, a first toner, about 50 weight percent, comprised of 90.5 percent of resin particles, such as styrene methacrylates or styrene butadienes, 7 percent of pigment, such as PV FAST BLUE™, internal charge additive, such as a mixture of 2 percent of BONTRON E-88™ and 0.5 percent of cetylpyridinium chloride, external surface additives, such as 0.6 percent of AEROSIL®, and 0.6 percent of zinc stearate is mixed with a second toner, about 50 weight percent, comprised of 92 percent of resin particles, such as styrene methacrylates, or styrene butadienes, 6.72 percent of pigment, such as LITHOL SCARLET® and 0.28 percent of HOSTAPERM PINK™, and internal charge additive to provide a purple toner. Moreover, in embodiments, a first toner, about 50 weight percent, comprised of 94.9 percent of resin particles, such as styrene methacrylates, or styrene butadienes, 5 percent of pigment, such as NEOPEN BLUE™, internal charge additive, such as 0.1 percent of DDAMS, external surface additives, such as 0.3 percent of AEROSIL®, and 0.3 percent of zinc stearate, is mixed with a second toner comprised of 92 percent of resin particles, such as styrene methacrylates, or styrene butadienes, pigment, such as LITHOL SCARLET® and 0.28 percent of HOSTAPERM PINK™, and internal charge additive, such as 1 percent of DDAMS to provide a blue toner. More than two toners, that is a plurality of toners, for example up to 10, may, it is believed, be mixed in a similar manner to provide preselected colored toners as illustrated herein. The toners mixed can be utilized in various effective amounts, such as for example from about 1 to about 99 percent of the first toner, and about 99 to about 1 percent of the second toner, but more preferably from about 90 to about 10 of the first toner, and about 10 to about 90 of the second toner.

The toner compositions of the present invention can be prepared by a number of known methods, such as admixing and heating resin particles such as styrene butadiene copolymers, pigment particles such as magnetite, carbon black, color pigments, or mixtures thereof, and preferably from about 0.5 percent to about 5 percent of the aforementioned internal charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, there is added to the toner surface additives.

Illustrative examples of suitable toner resins selected for the toners include polyamides, polyolefins, styrene acrylates, styrene methacrylates, styrene butadienes, PLIOTONE®, a styrene butadiene available from Goodyear Chemical, crosslinked styrene polymers, epoxies, polyurethanes, polyesters, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene, and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Specific examples of toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers, may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers and styrene/butadiene copolymers; PLIOLITES™; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 7,000, such as polyethylene, polypropylene, and paraffin waxes, can be included in, or on the toner compositions as fuser roll release agents. Also, the extruded polyesters of U.S. Pat. No. 5,376,494 and U.S. Pat. No. 5,227,460, the disclosures of which are totally incorporated herein by reference, can be selected as the toner resin.

The resin particles are present in a sufficient, but effective amount, for example from about 70 to about 90 weight percent. Thus, when 1 percent by weight of the dispersed internal charge enhancing additive is present, and 10 percent by weight of pigment or colorant, such as carbon black, is contained therein, about 89 percent by weight of resin is selected. The blend compatibility component is present on the toner surface in various effective amounts, such as for example from about 0.01 to about 1 weight percent.

Numerous well known suitable pigments or dyes can be selected as the colorant for the toner particles including, for example, carbon black, like REGAL 330®, nigrosine dye, aniline blue, magnetite, or mixtures thereof. The pigment is generally present in various effective amounts, such as in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be present in embodiments. Preferred pigments selected are colored pigments other than black and magnetites as illustrated herein.

When the pigment particles are comprised of magnetites, thereby enabling single component toners in some instances, which magnetites are considered to be a mixture of iron oxides ($FeO-Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black and magnetite, such as MAPICO BLACK®, in an amount of, for example, from about 5 to about 60, and preferably from about 10 to about 50 weight percent can be selected.

There are blended, preferably with the first toner composition of the present invention, external additive particles including flow aid additives, which additives are present on the surface thereof. Examples of these additives include fumed silicas, such as AEROSIL®, metal salts and metal salts of fatty acids inclusive of zinc stearate, aluminum oxides, cerium oxides, titanium oxides, other similar metal oxides, and mixtures thereof, which additives are generally present in an amount of from about 0.4 percent by weight to about 0.7 percent by weight, and preferably in an amount of from about 0.6 percent by weight. Several of the aforementioned additives are illustrated in U.S. Pat. Nos. 3,590,000 and 3,800,588, the disclosures of which are totally incorporated herein by reference.

There can be included in the toner compositions of the present invention low molecular weight waxes, such as polypropylenes and polyethylenes commercially available from Allied Chemical and Petrolite Corporation, EPOLENE N-15™ commercially available from Eastman Chemical Products, Inc., VISCOL 550™, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference.

The low molecular weight wax materials are usually present in the toner composition of the present invention in various amounts, however, generally these waxes are present in or on the toner composition in an amount of from about 1 percent by weight to about 15 percent by weight, and preferably in an amount of from about 2 percent by weight to about 10 percent by weight.

Examples of toner colorants, or pigments other than black include red like LITHOL SCARLET™, blue, green, like Heliogen Green, brown, magenta, cyan and/or yellow pigments, dyes, or mixtures thereof. More specifically, with regard to the generation of color images illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, HOSTAPERM PINK E® or HOSTAPERM PINK EB®, both obtained from Hoechst A.G. of Germany, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, PV FAST BLUE™, Neopen Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts. In embodiments, these colored pigment particles are present in the toner composition in an amount of from about 2 percent by weight to about 15 percent by weight calculated on the weight of the toner resin particles.

For the formulation of developer compositions, there are mixed, or comixed with the toner carrier components, particularly those that are capable of triboelectrically assuming an opposite polarity to that of the toner composition. Accordingly, the carrier particles can be selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, continuous or semicontinuous, which coating can be present in embodiments in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. No. 4,937,166 and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight are selected. Carriers can be selected to also enable negatively charged toners.

Furthermore, the diameter of the carrier particles, preferably spherical in shape, is generally from about 50 microns to about 1,000, and preferably about 75 to about 175 microns thereby permitting them to possess sufficient density and inertia to avoid adherence to the electrostatic images during the development process. The carrier component can be mixed with the toner composition in various suitable combinations, however, in embodiments about 1 to 5 parts per toner to about 100 parts to about 200 parts by weight of carrier are selected.

The toner and developer compositions of the present invention may be selected for use in electrostatographic imaging and printing apparatuses containing therein conventional photoreceptors that are capable of being charged negatively. Thus, the toner and developer compositions can be used with layered photoreceptors comprised of photogenerating layers and charge transport layers, and that are capable of being charged negatively, such as those described in U.S. Pat. No. 4,265,990, the disclosure of which is totally incorporated herein by reference. Illustrative examples of inorganic photoreceptors that may be selected for the imaging and printing processes include selenium; selenium alloys, such as selenium arsenic, selenium tellurium and the like; halogen doped selenium substances; and halogen doped selenium alloys. Other similar photoreceptors can be selected providing many of the main objectives of the present invention are achievable. Also, the toners obtained with the processes of the present invention can be selected for trilevel color xerography, reference U S. Pat. No. 4,078,929, the disclosure of which is totally incorporated herein by reference.

The toner compositions are usually jetted and classified subsequent to preparation to enable toner particles with a preferred average diameter of from about 5 to about 25 microns, and more preferably from about 8 to about 12 microns. Also, the toner compositions of the present invention preferably possess a triboelectric charge of from about 10 to about 20, and preferably from about 10 to about 15 microcoulombs per gram, determined by the known Faraday Cage method. Admix time for the toners of the present invention are preferably from about 5 seconds to 1 minute, and more specifically from about 5 to about 15 seconds in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 7copies per minute.

The following Examples are being provided to further define various species of the present invention, it being noted that these Examples are intended to illustrate and not limit the scope of the present invention. Parts and percentages are by weight unless otherwise indicated.

EXAMPLE I

There was prepared in an extrusion device, available as ZSK53 from Werner Pfleiderer, a red toner composition by adding to the device a first toner comprised of 92 percent by weight of suspension polymerized styrene butadiene copolymer resin particles (87/13), reference U.S. Pat. No. 4,558,108, the disclosure of which is totally incorporated herein by reference; 6.72 percent of LITHOL SCARLET™, 0.28 weight percent of the pigment HOSTAPERM PINK E™, and 1 percent by weight of the charge enhancing additive distearyl dimethyl ammonium methyl sulfate. The toner product, which was extruded at a rate of 300 pounds per hour, reached a melting temperature of 385±5° F. The extrudate was pelletized by a Mist-Water Grandulator (MWG) and the pellets subsequently cooled by immersing them in a water bath maintained at room temperature, about 25° C. Subsequent to air drying, the resulting toner was processed in a 800AFG grinder to produce toner particles with a volume median diameter of from 11 to 13 microns as measured by a Layson cell. Thereafter, the aforementioned toner particles were classified through two Donaldson Model B classifiers connected in series for the primary purpose of removing fine particles, that is those with a volume median diameter of less than 4 microns. There was then added to the toner surface 0.6 percent of AEROSIL R972® and 0.6 percent of zinc stearate by mixing the above prepared toner with the aforementioned two surface additives in a 75 liter Henschel blender operating at 1,500 rpm for 10 minutes. The above red toner was not passed through a turbo screener.

A second toner was prepared by repeating the above process except that 7 percent of the pigment HELIOGEN GREENTM and 1 percent of the charge control additive DDAMS were added to the resin during extrusion, and no surface additives were selected. The grinding and classifying were the same as for the red above, and the green toner was not passed through a turbo screener.

The aforementioned second (green) and first (red) toners were then added to a 75 liter Henschel blender in a 50:50 ratio (15 pounds of red, and 15 pounds of green), and mixed for 5 minutes at 880 rpm, followed by an additional 10 minutes at 1,500 rpm, and there resulted a brown toner, that was passed through a 37 micron turbo-screener to remove large particles. The brown toner resulting possessed an excellent charge spectra as determined by the known charge spectrograph, thus for example, there was minimal wrong sign negative charge toner, and stable desirable triboelectric characteristics wherein the triboelectric charge of the brown toner was +12.4 microcoulombs per gram as determined by the known Faraday Cage method.

A number of toners were prepared by repeating the above process with the components illustrated in the following Table:

TABLE

| | PIGMENT | RESIN | INTERNAL CCA | EXTERNAL ADDITIVE | RATIO | COMMENT PROCESS |
|---|---|---|---|---|---|---|
| Example I Toner 1 | 6.72% Lithol Scarlet 0.28% Hostaperm Pink | 92.0% Pliotone | 1.0% DDAMS | Master batch 0.6% Aerosil R972 0.6% ZnSt | 50% w/#2 | Base toner classified |
| Example I Toner 2 | 7% Heliogen Green | 92.0% Pliotone | 1.0% DDAMS | w/o Additives | 50% w/#1 | Base toner classified |
| Example II Toner 1 | 7% Heliogen Green | 92.0% Pliotone | 1.0% DDAMS | Master batch 0.6% Aerosil R972 0.6% ZnSt | 50% w/#2 | Base toner classified |
| Example II Toner 2 | 6.72% Lithol Scarlet 0.28% Hostaperm Pink | 92.0% Pliotone | 1.0% DDAMS | w/o Additives | 50% w/#1 | Base toner classified |
| Example III Toner 1 | 7% Heliogen Green | 92.0% Pliotone | 1.0% DDAMS | 0.3% Aerosil R972 0.3% ZnSt | 50% w/#2 | Base toner classified |
| Example III Toner 2 | 6.72% Lithol Scarlet 0.28% Hostaperm Pink | 92.0% Pliotone | 1.0% DDAMS | 0.3% Aerosil R972 0.3% ZnSt | 50% w/#1 | Base toner screened |
| Example IV Toner 1 | 7% Heliogen Green | 92.0% Pliotone | 1.0% DDAMS | 0.3% Aerosil R972 0.3% ZnSt | 50% w/#2 | Base toner screened |
| Example IV Toner 2 | 6.72% Lithol Scarlet 0.28% Hostaperm Pink | 92.0% Pliotone | 1.0% DDAMS | 0.3% Aerosil R972 0.3% ZnSt | 50% w/#1 | Base toner screened |
| Example V Toner 1 | 2% PV Fast Blue | 97.15% Pliotone | 0.60% DDAMS 0.25% CPC | Master batch 0.6% Aerosil R972 0.6% ZnSt | 50% w/#2 | Final Color (Purple) |
| Example V Toner 2 | 7% PV Fast Blue | 90.5% Pliotone | 2.0% E88 0.5% CPC | w/o Additives | 50% w/#1 | |
| Example VI Toner 1 | 3.5% Sunfast Magenta | 95.15% Pliotone | 1.35% DDAMS | Master batch 0.6% Aerosil R972 0.6% ZnSt | 50% w/#2 | Final Color (Teal) |
| Example VI Toner 2 | 6.72% Lithol Scarlet 0.28% Hostaperm Pink | 92.0% Pliotone | 1.0% DDAMS | w/o Additives | 50% w/#1 | |

Examples I to IV represent one blended color—brown.

Examples V to VI represent other color blend combinations at 1:1 ratio with the master batch technique. E88™ is an aluminum complex obtained fro m Hodogaya Chemicals.

EXAMPLE VII

A brown toner (TB-14012-13) was prepared by repeating the process of Example I and with the same classified first green and red toners, and which preparation was accomplished with different blending sequences. In the first Henschel blending, 30 pounds of the green classified toner was added to the Henschel blender and combined with 0.6 percent each of AEROSIL R9720 and zinc stearate by blending for 10 minutes at 1,500 rpm. In the second blending step, 15 pounds of the above green toner containing 0.6 percent additives was combined in the Henschel blender with 15 pounds of the classified red toner without additives and mixed for 5 minutes at 880 rpm, followed by mixing for an additional 10 minutes at 1,500 rpm, then was passed through a 37 micron turbo-screener to remove large particles. The resulting toner had favorable charge spectra and excellent tribo properties, 11.7 microcoulombs per gram.

EXAMPLE VIII

The starting components for this Example were comprised of screened red (with surface additives) and classified, no surface additives, green toners, reference the above Examples. The red toner contained 0.3 percent of both AEROSIL R972® and zinc stearate, and which toner was turbo-screened through a 37 micron screen. The green toner was a classified toner that had not yet been mixed with surface additives. A brown toner was prepared by combining 15 pounds each of the above green classified toner (which contained no external additives) with 15 pounds of the above red screened toner (which contained 0.3 percent each of AEROSIL R972® and zinc stearate), and with an additional amount of 0.3 percent each of AEROSIL R972® and zinc stearate to compensate for the 15 pounds of green toner that contained no such additives. The aforementioned mixture was blended for 10 minutes at 1,500 rpm, and the resulting batch was passed through a 37 micron turbo-screener. The resulting toner had favorable charge spectra and excellent tribo properties, 12.7 microcoulombs per gram.

Replenishers were prepared with the above brown toner (by adding 1 pound of Xerox Corporation 4850 color carrier to a Xerox Corporation 4850 bottle with 3 pounds of the above prepared brown blended toner). The color carrier was comprised of an unoxidized Hoeganaes core, about 105 microns average diameter, containing 0.8 percent solution (20 percent solids in MEK) coated (80/20 PMMA/CB). These replenishers were utilized in a Xerox Corporation 4850 and there resulted brown images with excellent color intensity, and superior line and solid resolution. PMMA is polymethylmethacrylate; MEK is methylethyl ketone; and CB is REGAL 330® carbon black.

EXAMPLE IX

The process of Example VIII was repeated except that a red classified toner and a green screened toner were selected. Substantially similar results as reported above were obtained.

Other modifications of the present invention may occur to those skilled in the art subsequent to a review of the present application, and these modifications, including equivalents thereof, are intended to be included within the scope of the present invention.

What is claimed is:

1. A process for the preparation of colored toners consisting essentially of mixing a first toner consisting essentially of resin, pigment particles, charge additive, and surface additives of zinc stearate and fumed silica, each present in an amount of from about 0.4 to about 0.8 weight percent, with a second toner consisting essentially of resin, pigment particles, and charge additive, and wherein the resulting colored toners contain from about 0.2 to about 0.3 weight percent of said zinc stearate and from about 0.2 to about 0.3 weight percent of said fumed silica.

2. A process in accordance with claim 1 wherein the amount of said silica and said zinc stearate present in the first toner is from about 0.4 to about 0.7 weight percent for said zinc stearate and from about 0.4 to about 0.7 weight percent for said silica.

3. A process in accordance with claim 1 wherein the amount of said silica present in the first toner is about 0.6 weight percent, and the amount of zinc stearate present in the first toner is about 0.6 weight percent, and the amount for each of said silica and said zinc stearate present in the resulting toner is about 0.3 weight percent.

4. A process in accordance with claim 1 wherein from about 10 t o about 90 weight percent of the first toner is selected, and from about 90 to about 10 weight percent of the second toner is selected.

5. A process in accordance with claim 1 wherein from about 50 weight percent of the first toner is selected, and from about 50 weight percent of the second toner is selected.

6. A process in accordance with claim 1 wherein the mixing is accomplished after adding the first toner to the second toner.

7. A process in accordance with claim 6 wherein the amount of said silica present in the first toner is about 0.6 weight percent, and said zinc stearate is present in the first toner in an amount of about 0.6 weight percent, and the amount for each of said silica and said zinc stearate present in the resulting toner is about 0.3 weight percent.

8. A process in accordance with claim 1 wherein the mixing is accomplished after adding the second toner to the first toner.

9. A process in accordance with claim 1 wherein the resin is a styrene acrylate, a styrene methacrylate, a styrene butadiene, or a polyester; the triboelectric charge of the resulting toner is from about 10 to about 15 microcoulombs per gram; and the admix time of the resulting toner is from about 15 to about 30 seconds.

10. A process in accordance with claim 1 wherein the pigment particles are comprised of red, green, blue, yellow, brown, cyan, magenta, or mixtures thereof.

11. A process in accordance with claim 1 wherein the charge additive assists in charging the toner positively.

12. A process in accordance with claim 11 wherein the charge additive is distearyl dimethyl ammonium methyl sulfate, or cetyl pyridinium chloride.

13. A process in accordance with claim 1 wherein the charge additive assists in charging the toner negatively.

14. A process in accordance with claim 13 wherein the charge additive is an aluminum complex.

15. A process in accordance with claim 13 wherein the charge additive is tris(3,5-di-tertiary-butylsalicylato) aluminum.

16. A process in accordance with claim 1 wherein the charge additive is distearyl dimethyl ammonium methyl sulfate, cetyl pyridinium chloride, or mixtures thereof.

17. A process in accordance with claim 1 wherein said resulting toner after blend contains a blend of toners, which blend after blend contains a palette of colors.

18. A process in accordance with claim 1 wherein two toners are mixed to obtain a third toner mixture with a color different than the first or second toner.

19. A process in accordance with claim 1 wherein the charge additive is selected from the group consisting of alkyl pyridinium halides, metal complex salts, and quaternary ammonium compounds.

20. A process in accordance with claim 1 wherein the first toner contains a cyan pigment, the second toner contains a blue pigment, and the resulting toner is light blue in color.

21. A process in accordance with claim 1 wherein the first toner contains a red pigment, the second toner contains a blue pigment, and the resulting toner is royal blue in color.

22. A process in accordance with claim 1 wherein the first toner contains a magenta pigment, the second toner contains a red pigment, and the resulting toner is deep red in color.

23. A process in accordance with claim 1 wherein the first toner contains a red pigment, the second toner contains a green pigment, and the resulting toner is brown in color.

24. A process in accordance with claim 1 wherein the first and second toners contain pigment in an amount of from about 2 to about 10 weight percent, from about 0.1 to about 3 weight percent of charge additive, and from about 75 to about 90 weight percent of resin.

25. A process for the preparation of a colored toner consisting of adding a first toner consisting of resin, pigment, optional charge additive, and surface additives of zinc stearate and fumed silica each present in an amount of from about 0.4 to 0.8 weight percent, to a second toner consisting of resin, pigment, and optional charge additive, and wherein the resulting toner contains from 0.2 to about 0.3 weight percent of said zinc stearate and 0.3 weight percent of said fumed silica.

26. A process in accordance with claim 25 wherein the amount of said silica and said zinc stearate present in the first toner is from about 0.4 to about 0.7 weight percent, and which weight percent is for each of said zinc stearate and said silica.

27. A process in accordance with claim 25 wherein the amount of said silica and said stearate present in the first toner is about 0.6 weight percent, and the amount of said silica present in the first toner is about 0.6 weight percent, and the amount of said stearate present in the resulting toner is about 0.3 weight percent.

28. A process for the preparation of developer compositions consisting essentially of mixing a first toner consisting essentially of resin, pigment particles, charge additive, and surface additives of zinc stearate and fumed silica, each present in an amount of from about 0.4 to about 0.8 weight percent, with a second toner consisting essentially of resin, pigment particles, and charge additive, and wherein the resulting colored toners contain from about 0.2 to about 0.3 weight percent of said zinc stearate and from about 0.2 to about 0.3 weight percent of said fumed silica with carrier particles.

29. A process for the preparation of developer compositions consisting essentially of mixing a first toner consisting essentially of resin, pigment, optional charge additive, and surface additives of zinc stearate and fumed silica each present in an amount of from about 0.4 to 0.8 weight percent, with a second toner consisting essentially of resin, pigment particles, and optional charge additive, and wherein the resulting toner contains from about 0.2 to about 0.3 weight percent of said zinc stearate and from about 0.3 weight percent of said fumed silica, with carrier particles.

* * * * *